United States Patent [19]

Schuller

[11] Patent Number: 4,859,163

[45] Date of Patent: Aug. 22, 1989

[54] ROTARY PUMP HAVING VANES GUIDED BY BEARING BLOCKS

[75] Inventor: Steven C. Schuller, Markham, Canada

[73] Assignee: Steven Schuller Performance Inc., Markham, Canada

[21] Appl. No.: 66,162

[22] Filed: Jun. 25, 1987

[51] Int. Cl.[4] ..... F04C 18/344

[52] U.S. Cl. ..... 418/192; 418/235; 418/261

[58] Field of Search ..... 418/192, 235, 261, 264, 418/260, 178, 131, 259, 269

[56] References Cited

U.S. PATENT DOCUMENTS

| | | | |
|---|---|---|---|
| 300,998 | 6/1884 | Moffet | 418/260 |
| 931,899 | 8/1909 | Tompkins | 418/192 |
| 1,009,759 | 11/1911 | Liston et al. | 418/192 |
| 1,326,684 | 12/1919 | Newland | 418/192 |
| 1,644,029 | 10/1927 | Porsche | 123/559.1 |
| 1,720,414 | 7/1929 | Gruebler | 123/559.1 |
| 1,833,275 | 11/1931 | Burmeister | 169/15 |
| 2,672,282 | 3/1954 | Novas | 418/264 |
| 3,001,482 | 9/1961 | Osborn | 418/85 |
| 3,461,974 | 8/1969 | Bartos | 418/235 |
| 3,822,676 | 7/1974 | Richter | 418/261 |
| 3,915,598 | 10/1975 | Kalen et al. | 418/269 X |
| 3,988,083 | 10/1976 | Shimizu et al. | 418/264 |
| 4,209,286 | 6/1980 | Schwartz | 418/260 |
| 4,212,603 | 7/1980 | Smolinski | 418/256 |
| 4,396,365 | 8/1983 | Hayashi | 418/235 |

FOREIGN PATENT DOCUMENTS

| | | | |
|---|---|---|---|
| 0081591 | 4/1986 | Japan | 418/235 |
| 16011 | of 1896 | United Kingdom | 418/192 |

*Primary Examiner*—John J. Vrablik
*Assistant Examiner*—Leonard P. Walnoha
*Attorney, Agent, or Firm*—Rogers, Bereskin & Parr

[57] ABSTRACT

The rotary machine, for example an air pump, has two rotors and vanes carried by the rotors within a housing, to pump fluid between an inlet and an outlet on opposite sides of the housing. The vanes are guided by tracks, so that the vanes are withdrawn flush with the rotor surfaces at a contact line between the rotors. In one embodiment, ends of the vanes are carried in carriers by means of bearing blocks. The carriers rotate at an average speed equal to that of the rotors, to reduce the movement of the ends of the vanes. The mechanism can be employed in a single rotor machine.

17 Claims, 5 Drawing Sheets

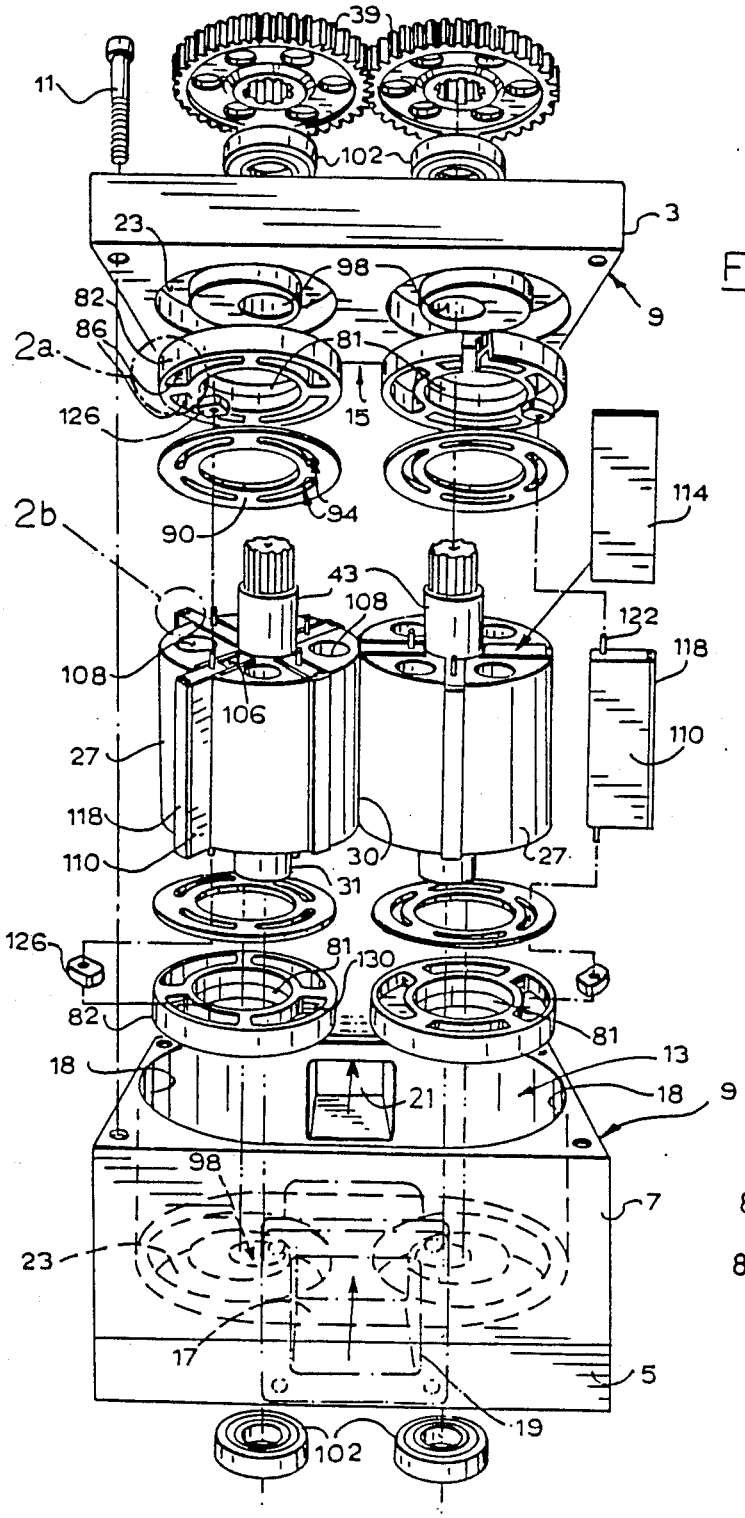
FIG. 2
FIG. 2b
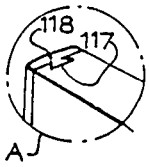
FIG. 2a
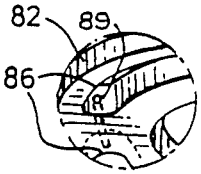

ROTARY PUMP HAVING VANES GUIDED BY BEARING BLOCKS

FIELD OF THE INVENTION

The present invention relates to rotary machines and more particularly to rotary machines of the type used as air pumps.

BACKGROUND OF THE INVENTION

Many rotary machines use a Roots type of blower, having two lobed rotors. Alternating with the lobes of each rotor are channels. Each lobe engages a corresponding channel of the other rotor as the rotors are rotated. In order to pump air, the rotors are rotated causing the lobes and channels of the opposing rotors to mesh. During this meshing action, as well as air being pumped from an inlet to an outlet, fluid is squeezed out of the area between the lobes and channels of the opposing rotors. Also, as the lobes leave the channels, air is drawn into the channels. There is thus a continuous pumping action of air entering and leaving the channels, which results in excessive heat generation. As the air is compressed its temperature rises. This rise in temperature, combined with frictional wear, tends to create premature wear and ultimate failure.

Roots blowers are used on a variety of internal combustion engines. In particular, they are commonly used on diesel engines for trucks. For such uses, they can provide adequate supercharging. Being a simple, robust unit, they are relatively reliable.

However, as is known, Roots blowers have limitations. There is no direct compression of air in the blower, and they are best suited for developing relatively low pressures.

Such Roots type blowers developed for trucks have been adapted for cars in so-called drag racing. For this purpose, it is necessary for the engine to develop a high level of power for a short time. To this end, the Roots blowers are rotated at relatively high speeds. This produces inefficiencies, and in many cases leads to premature failure of the blower, as it is overstressed. This type of Roots blower is made from cast aluminum with tight tolerances. At high loadings, the rotors can deflect to contact the casing causing wear.

Another type of pump used is the rotary vane pump, an example of which is disclosed in U.S. Pat. No. 4,212,603, issued July 15, 1980. This pump employs a single vaned rotor, rotating within a housing. The rotor is adjacent to the housing during a portion of the rotation. The vanes slide in slots and are guided on bearings about a cam to contact the housing at all times.

Parts of this structure have typically been made from metal components. When the pump is required to be used at high speeds a great deal of wear can occur between the various components.

Accordingly, it is seen that there is a need for an improved rotary machine which minimizes wear of the components. Further, for such uses as supercharging, it is desirable that the mechanism should not require the use of lubricating oil mist or the like.

SUMMARY OF THE INVENTION

A rotary pump includes a housing defining a chamber. The chamber has two end surfaces, and first and second sealing surfaces between the end surfaces. The end surfaces have respective first and second axes. Inlet and outlet ports are disposed opposite one another between the sealing surfaces. One first track and one second track are on one end surface of the chamber. Another first track and another second track are on the other end surface of the chamber. Each of the first and second tracks is continuous. The first tracks extend around the first axis and the second tracks extend around the second axis. A first rotor is rotatably mounted within the chamber for rotation about the first axis, the first rotor including a plurality of first slots. A second rotor is rotatably mounted within the chamber for rotation about a second axis, the second rotor including plurality of second slots. The first and second rotors sealingly contact one another at a contact line therebetween and between the first and second axes. A plurality of first vanes, each vane having a sealing edge and being slidably received in a slot of the first rotor, are rotatable with the first rotor about the first axis with the sealing edges of the vanes projecting outwardly. A plurality of second vanes, each vane having a sealing edge, and being slidably received in a slot of the second rotor, are rotatable with the second rotor about the second axis with the sealing edges of the vanes projecting outwardly. First track following means engage the first vanes with the first tracks. The first tracks guide the first vanes, such that each first vane contacts sealing the first sealing surface and is withdrawn into the first slots of the first rotor as that vane passes the contact line between the rotors. Second track following mean engage the second vanes with the second tracks. The second tracks guide the second vanes, such that each second vane contacts sealingly the second sealing surface and is withdrawn into the second slots of the second rotor as that vane pases the contact line between the rotors. The pumps further include means for rotating the first and second rotors in opposite directions. In use, with the rotors rotated such that the vanes contacting the sealing surface move from the inlet port to the outlet port, those vanes pump fluid from the inlet port to the outlet port.

The track following means may include, for each track, a carrier rotatably mounted within the track. Preferably, the carrier then defines a plurality of arcuate recesses which extend around an annulus and are separated by cross pieces. Each vane is pivotally mounted at either end by stub shafts engaging bores of two bearing blocks.

The rotors may be substantially cylindrical. The rotors may be mounted with respective synchronizing gears, the gears engaging one another at a line between the first and second axes. The bearing blocks may be formed of self-lubricating plastic. The sealing edges of the vanes may be made of self-lubricating plastic. The slots of the vanes may be lined with self-lubricating plastic bearing plates.

In accordance with another aspect of the present invention, there is provided a rotary machine. A rotary pump comprising: a housing defining a chamber, the chamber having two end surfaces, a sealing surface extending around the chamber between the end surfaces, the chamber having an axis, and inlet and outlet ports opening into the chamber, a first track on one end surface of the chamber, and a second track on the other end surface of the chamber, each of the first and second tracks being continuous and extending around the chamber axis, a rotor rotatably mounted within the chamber for rotation about the first axis, and including a plurality of first slots, a plurality of vanes, each vane having a sealing edge and being slidably received in a slot off the first rotor and rotatable therewith about the axis with the sealing edges of the vanes projecting outwardly, a first and second annular carriers rotatably mounted in the first and second tracks respectively, each annular carrier including at least one arcuate bearing surface, a plurality of first blocks mounted on the first annular carrier for relative movement along the arcuate bearing surface thereof, a plurality of second blocks mounted on the second annular carrier for relative movement along the arcuate bearing surface thereof, and each vane being pivotally mounted to a respective first bearing block and a respective second bearing block, wherein the first and second annular carriers are mounted such that, in use, as the rotor rotates and the vanes travel along the sealing surface from the inlet to the outlet, the vanes extend out from the rotor adjacent the inlet to draw fluid into the pump, and the vanes are withdrawn into the rotor adjacent the outlet to discharge fluid from the pump, and the vanes are maintained in sealing contact with the sealing surface.

DESCRIPTION OF THE DRAWINGS

For a better understanding of the present invention, and to show more clearly how it may be carried into effect, reference will now be made, by way of example to the accompanying drawings, which show preferred embodiments of the present invention, and in which:

FIG. 2 is an exploded perspective view of a pump according to a second embodiment of the present invention;

Whilst the pump of the present invention can be configured for pumping liquids, or gases, it is described in relation to a pump for pumping or blowing air.

Figure 1:
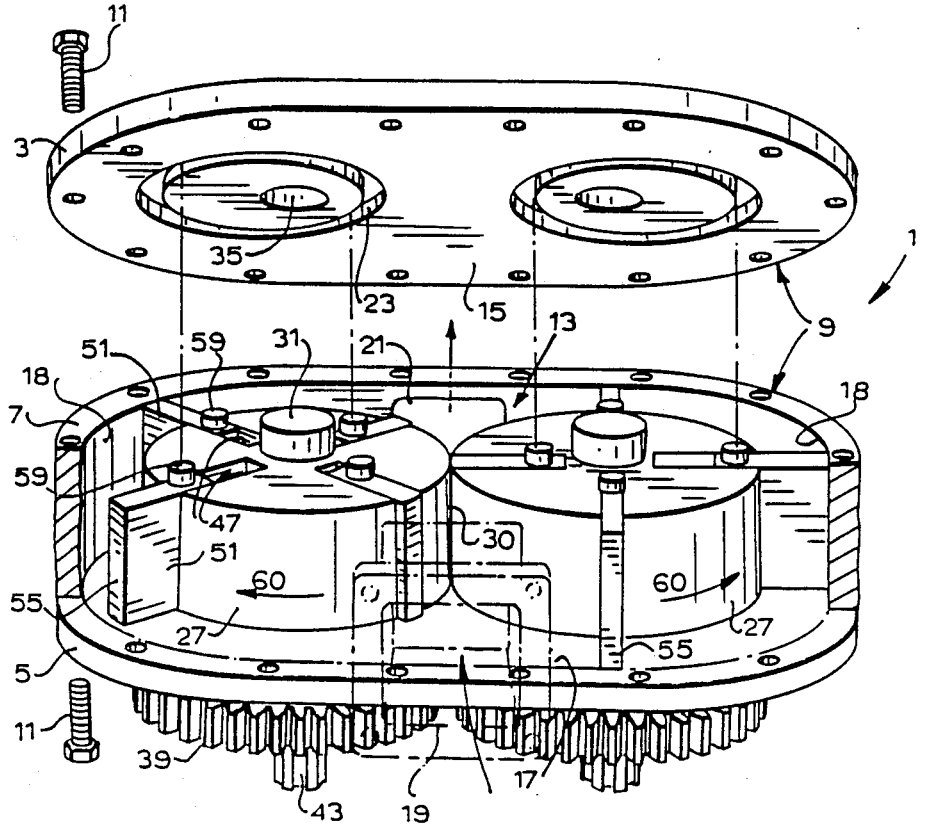
FIG. 1 is a partially exploded perspective view of a pump according to the first embodiment of the present invention.

Referring to FIG. 1, a first embodiment of a rotary pump 1 has two end plates 3 and 5. Between the end plates 3 and 5, is a central member 7 forming a continuous wall. Together the end plates 3 and 5 and the central member 7 form a housing 9. The end plates 3 and 5 are fastened to the central member 7 by bolts 11. The interior surfaces of the plates, 3 and 5, and the central member 7 form a chamber 13.

The chamber 13, viewed in a section parallel to the end plates 3, 5, has an elongated shape, with straight front and rear parts and semicircular end portions. Two portions of the wall 7, corresponding to the semicircular end portions of the chamber 13, define semicircular sealing surfaces 18. Opposite one another in front and rear parts of the wall, are inlet and outlet ports 19 and 21, respectively.

The end platès 3, 5 are generally of identical construction and are symmetrical about a central plane parallel to and equally spaced from the plates 3, 5. Accordingly, only the plate 3 is described in detail. The end plate 3 has one end surface 15 bounding the chamber 13. This end surface 15 has two continuous tracks 23. The other end plate 5 has two corresponding continuous tracks (not shown), one opposite each of the tracks 23 on end surface 15. The tracks 23 are recessed as shown in FIG. 1. Alternatively, continuous protrusions can be formed on the end plates 3, 5. The tracks 23 are centered on the same axes as the semicircular sealing surfaces 18, so that the radial extent between each track 23 and the associated sealing surface 18 is constant. The end plate 3 also includes openings 35 for rotor shafts, discussed below. Here, for simplicity, the openings 35 are shown as simple sleeves, although in known manner the rotors are mounted in bearings. The axes of the openings 35 are parallel to the axes of the tracks 23, but eccentric and offset inwards. The axes of the openings 35 and the axes of the tracks 23 are in a straight line with the axes of tracks 23 outside the axes of the openings 35. The openings 35 are within the respective tracks 23.

Two rotors 27 are provided. Each rotor 27 includes a respective shaft 31 that is rotatably mounted, by bearings, in opposite openings 35 in the end plates 3, 5. The rotors 27 contact sealingly one another at a contact line 30 between the rotors 27. The amount of clearance between the rotors 27 to allow for a sealing contact will depend on various factors, such as the difference in air pressure desired between the inlet and outlet ports, 19 and 21, the speed of rotation of the rotors 27, and the amount of fluid pumped per rotation. Generally, a few thousands of an inch will be appropriate clearance. The rotors are provided with shafts 31.

The ends of the shafts 31 are flush with the outside surface of end plate 3, and protrude through the end plate 5. The shafts 31 have splined shaft ends 43, where the shafts 31 protrude from the end plate 5. On the shaft ends 43 are fitted gears 39 having correspondingly splined bores. The gears 39 are of equal size and engage one another at a line between the shafts 31.

At least one rotor 27 is driven by a suitable drive. Where the pump is fitted in a supercharger to an internal combustion engine, a drive would then be taken from the engine crankshaft. The gears 39 then ensure that the two rotors 27 rotate at equal speed in opposite directions.

The rotors 27 are generally identical, and again, for simplicity, are described in relation to one of the rotors 27. Each rotor 27 is a generally cylindrical body. It includes four slots 47, which are parallel sided. Within each slot 47, there is a vane 51. Each vane 51 is parallel sided and dimensioned to be a free sliding fit in the slot 47.

At either end of each vane 51, adjacent its inner edge, there is a pivot 59. The pivot 59 comprises a stub shaft extending from the vane 51 on which a bearing is mounted. The bearing could be a needle roller bearing. The two pivots 59 for each vane 51 are located in the tracks 23.

Outer edges 55 of the vanes 51 form sealing edges. Tehse are profiled, so that there is always a small, predetermined clearance between the vane 51 and the sealing surface 18. It will be appreciated that, as detailed below, due to the eccentric mounting of the shaft 31, the vanes 51 are only radial to the sealing surface 18 at one point.

In use, as detailed below, the vanes 51 are caused to travel in and out of the slots 47. It is further to be realized that, as one vane 51 is moving radially inwards, the diametrically opposite vane 51 is moving radially outwards. To accomodate this, the center of the rotor 27 is provided with air transfer ports 28 joining diametrically opposite slots. Then, as one vane 51 moves inwards, the air displaced from its slot 47 is transferred to the diametrically opposite slot in which the vane is moving outwards. This should prevent any excessive pressure building up in the slots 47.

In operation, the shafts 31 are rotated in opposite directions, as shown by the horizontal arrows 60. This causes the rotors 27 to rotate in opposite directions. As the rotors 27 rotate, they remain in sealing contact with one another at the contact line 30. As will be evident to those skilled in the art, it is not necessary for the rotors 27 to be substantially cylindrical for pumping action to be produced. Thus, for some applications, it may be possible for the rotor to have alternative shapes that enhance the pumping action. An advantage to having substantially cylindrical rotors 27 is that air is not squeezed away from the contact line 30 as it is in a Roots type blower.

The gears 39 act to synchronize rotation of the rotors 27 and to ensure a vane 51 of one rotor 27 does not pass the contact line 30 at the same moment as a vane 51 of the other rotor passes the contact line 30. This avoids having the sealing edge 55 of one vane 51 of one rotor 27 catch in a slot 47 of the opposite rotor 27. The velocity of each of the rotors 27 at the contact line 30 is in the same direction. As the speeds of the rotors 27 are synchronized the relative velocity between the rotors 27 at the contact line 30 is zero. Since the vanes 51 are withdrawn at the contact line 30, there is no need for synchronisation. As shown, the vanes are synchronised so that the pulsations for each rotor are not superimposed, but this is not essential. It is possible for the vanes 51 to contact at the contact line 30. It is expected that the rotors 27 will encounter substantially reduced wear over rotors which contact non-moving housings as in U.S. Pat. No. 4,212,603, and Roots type blowers which have substantial relative velocities between their lobes and channels.

The vanes 51 rotate with the rotors 27. The tracks 23 and pivots 59 guide the vanes 51 as the rotors 27 are rotated. A portion of each track 23 opposite its respective sealing surfaces 18 follows a path similar to its respective sealing surface 18. The distance between each pivot 59 and its respective sealing edge 55 is matched to the radial distance between the respective sealing surface 18 and the respective tracks 23. The matching, with space left for a desired clearance between the sealing surfaces 18 and the sealing edges 55, forms a sealing contact therebetween. As the vanes 51 are guided by the tracks 23 about the shafts 31, the orientation of the vanes 51 is the same as the orientation of the slots 47. As the tracks 23 are not concentric with the shafts 31, the sealing edges 55 are rounded to form a good sealing contact for all positions of the vanes, and to lessen the amount of wear on the sealing edges 55 and the sealing surfaces 18.

The motion of the vanes 51 will now be described with reference to one vane 51 for the left hand rotor 27, just after it has passed the contact line 30. At this point, the vane 51 is fully withdrawn into its slot 47. As the rotor 27 rotates, the pivots 59 in the track 23 urge the vane 51 outwards. When the vane 51 reaches the beginning of the sealing surface 18 it is nearly fully extended. Due to the concentricity of the sealing surface 18 and the track 23, the vane 51 is carried around with its pivots 59 at a constant distance from the sealing surface 18. However, during this movement, due to the excentricity of the shaft 31 the vane 51 moves in its slot 47. Also, the vane 51 is not held radial to the surface 18, except when it is aligned with the rotor axes. However, the sealing edge 55 is configured to ensure that there is an adequate and uniform gap between the edge 55 and the sealing surface 18 as the vane 51 rotates. When the vane 51 leaves the sealing surface 18, it is then withdrawn by the action of the track 23 on pivots 59. It is withdrawn until it is flush with the rotor surface, so that it can pass by the other rotor 27 of the contact line 30.

The pumping action occurs between the vanes 51 and the sealing surface 18. Each pair of vanes 51 traps a pocket of air between those vanes and the sealing surface 18. This is carried around by the vanes as the rotor 27 rotates. Thus, as each vane 51 approaches the sealing surface 18 it traps a pocket of air, drawn in through the inlet port 19. Similarily, as each vane 51 leaves the sealing surface 18, it releases a pocket of air, for discharge through the outlet port 21.

The embodiment of FIG. 1 will cause bearings on the pivots 50 to rotate at the same angular velocity as the rotors 27. For many purposes, this means that the bearings will have to be needle bearings or the like, and some sort of lubricant will be required. For many uses, it is desirable that no lubricant is used. Thus, it is preferable to use self-lubricating plastic material. However, such material is best suited to low velocities.

Figure 3:
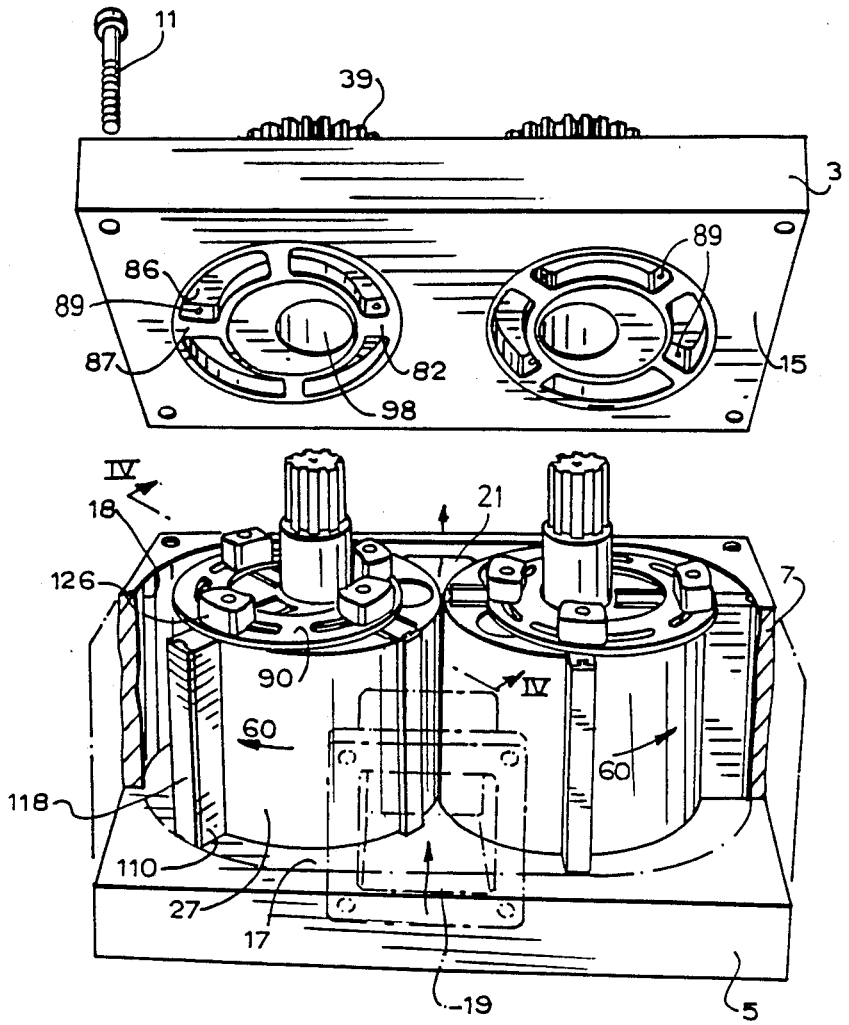
FIG. 3 is a perspective view partially exploded and partially in section of the pump of FIG. 2.
Figure 4:
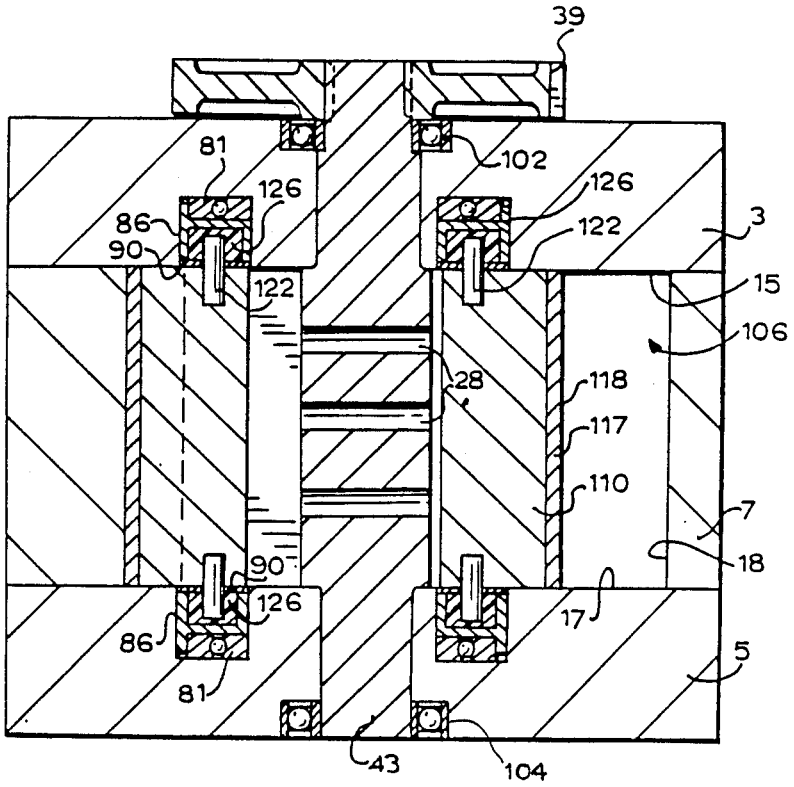
FIG. 4 is a cross-sectional view along line IV—IV of FIG. 3.

A description will now be given of the second embodiment of the present invention, with reference to FIGS. 2–4. In this embodiment, a mechanism is provided, reducing the velocity of the pivots for the vanes, so that self-lubricating plastic material can be used. Further, for simplicity, like parts in FIGS. 2–4 are given the same reference numeral as in FIG. 1, and the description of these parts is not repeated.

In one end surface 15 there are two continuous tracks 23. In the other end surface 17 are similar opposing tracks 23. Mounted in each track 23 by a bearing 81 is a trunnion or pivot carrier 82. The trunnion carriers 82 are thus free to rotate in the tracks 23. The trunnion carriers 82 have recesses 86 in their outward facing surfaces. The recesses 86 are all of equal size and part of a common annulus. Each recess 86 extends through slightly less than 90 degrees. Cross pieces 87 separate the recesses 86. Channels 89 are provided in the crosspieces 87.

To each trunnion carrier 82, a plate 90 is secured, for example by bolts extending into the crosspieces 87. In the plates 90, there are provided slotted holes 94 equal in number and similar in shape to the recesses 86. The holes 94 are narrower and shorter than the recesses 86, as will be later explained.

The shafts 31 fit through the openings 98 in the end plates, 3 and 5. Concentric with the openings 98, on the exterior surface of the end plates, 3 and 5, recessed circular seats 104 are provided, as shown in FIG. 4, into which fit bearings 102 for the shafts 31.

The shafts 31 are flush with the outside surface of the bearings 102 associated with end plate 5, and a cover would be provided to protect the bearings 102. The shafts 31 have splined shaft ends 43, where the shafts 31 protrude through the bearings 102 associated with end plate 3. Over the shaft ends 43 are placed gears 39, which are driven as described above.

Each rotor 27 is generally cylindrical and is provided with a plurality of slots 106 and the following description is for one of the rotors 27. The rotor 27 is machined out between the slots 106, as shown by bores 108, to lessen the weight of the rotor 27. The sides of the slots 106 are lined with self-lubricating plastic plates 114. To retain the plates 114, each side of each slot 106 includes a portion of its radially outer end that is stepped inwards, forming a step to hold the respective plate 114. Each slot 106 at its inner end has two channels extending radially inwards adjacent its sides, to hold the inner ends of the plates 114.

A vane 110 is mounted in each slot 106, and the plates 114 lessen wearing of the slots 106 and vanes 110, and heat build-up therebetween. The vanes 110 project outwardly from the slots 106. A sealing edge strip 117 is made of self-lubricating plastic material and is connected by a dovetail arrangement, as shown in inset A of FIG. 2. The sealing edge strip 117 defines a sealing edge 118.

Each vane 110 is provided at its two ends with trunnions or stub shafts 122. Bearing blocks 126 are made of self-lubricating plastic material and one block 126 is fitted into each recess 86 of the carriers 82. Each stub shaft 122 extends through one hole 94 in one plate 90, and into a bore of a respective bearing block 126.

Each bearing block 126 has arcuate inner and outer surfaces corresponding to the shape of the recesses 86. The ends of each bearing block correspond to the shape of the ends of the recesses 86. The blocks 126 are thus mounted in the recess 86 for free circumferential movement between the adjacent cross pieces 87. Whereas in the first embodiment a stub shaft and bearing provides a track following means, in this second embodiment, the carrier 82, bearing block 126 and trunnions or stub shafts 122 provide the track following means.

The recesses 86 define bearing surfaces for the blocks 126. It will be appreciated that the recesses 86 could be protrusions and the bearing blocks 126 correspondingly shaped. The holes 94 in the plate 90 are wide enough to accept the shafts 122, without the shafts 122 contacting the plates 90. The holes 94 are long enough for the shafts 122 not to contact the plates 90 when the bearing blocks 126 are contacting the ends of a recesses 86. The plates 90 are designed to minimize the leakage of air from the outlet 21 to the inlet 19 through the recesses 86. The channels 89 in the crosspieces 87 serve a similar function to the transfer ports 28. The channels 89 enable air to be displaced from each recess 86, as the blocks 126 slide in the recesses 86.

In operation, the gears 39 are rotated in opposite directions, as shown by the horizontal arrows of FIG. 2. The gears in this embodiment are at the opposite end of the device, adjacent to the end plate 3. The vanes 110 will rotate with the rotors 27. The shafts 122 will force the bearing blocks 126 to rotate with shafts 31. Simultaneously, the recesses 86 control the motion of the vanes 110 relative to the rotors 27.

The basic motion of the vanes 110 and rotors 27, relative to the sealing surfaces 18 is as described above for the first embodiment, and is not repeated.

The following description relates to the motion of the bearing blocks 126 relative to the carriers 82. It should be appreciated that the rotors 27 are rotated at a generally constant angular velocity. Accordingly, the linear velocity of the stub shafts 122 will vary depending on the radial position of the rotors 27.

During rotation, one of the bearing blocks 126 in each rotor 27 will contact a crosspiece 87 of a recess 86 in each of the trunnion carriers 82, propelling the trunnion carriers 82. As the rotors 27 rotate further, the vanes 110 propelling the trunnions 126 will be withdrawn into their respective slots 106, reducing the speed of the corresponding bearing blocks 126. Those bearing blocks 126 will come away from the leading crosspieces 87 of their respective recesses 86. In turn, other bearing blocks 126 will reach the end of their respective recess 86 and continue to propel the trunnion carrier 82 about the track 23. Returning to the original bearing blocks 126 their respective vanes 110 will be withdrawn into their respective slots 106 as the vanes 110 pass the contact line 30 between the rotors 27. The speed of the vanes 110, and therefore the blocks 126, relative to the trunnion carriers 82 will increase as the bearing blocks 126 are guided by the tracks 23 away from the shafts 31.

The trunnion carriers 82 will have an average angular velocity from being propelled by the trunnions 126 equal to the angular velocity of the shafts 31. It is expected that there may be periods during a rotation when no bearing blocks 126 are in contact with their respective crosspieces 130. The trunnion carriers 82 will be carried forward by their own momentum and will be picked up by the next bearing blocks 126. The variation in angular velocity is not expected to be a large factor when the friction between the bearing blocks 126 and the recesses 86 is low. The relative movement of a bearing block 126 in its respective trunnion carrier 82 will be only due to the sliding motion of the vanes 110. As this motion is relatively slow when compared to the angular velocity of the shafts 31, the frictional heat buildup for the blocks 126 is expected to be relatively low. The blocks 126, during each rotation will travel from one end of the respect recess 86 to the other and back again. This makes is possible to form the bearing blocks 126 out of self-lubricating plastic, decreasing the wear on the trunnion carriers 82 and the stub shafts 122. This also eliminates the need for mixing a lubricating oil into the air stream.

Similarly the vanes 110 undergo relatively restricted reciprocal motion relative to the rotors 27, and again it is expected that plastic plates 114 will provide sufficient bearing surfaces.

Whilst the sealing edge strips 117 are travelling at a relatively high velocity relative to the sealing surface 18, there are a few thousandths of an inch clearance. The sealing edge 118 should only contact as a result of wear of the components, or operating the device under extreme conditions, resulting in deflection of the various components.

The sealing edge strips 117 may be easily replaced should they ever wear, by sliding them from the dovetail arrangement. The plastic plates 114 may be replaced should they wear due to the sliding motion of the vanes 110. Similarly, the bearing blocks 126 can be readily replaced.

Whilst the second embodiment of the invention is shown with self-lubricating plastic for the blocks 126 and plates 114, it is possible that other bearing arrangements could be used, depending upon such factors as the application, speed of rotation etc.

Also, whilst the drawings show square inlet and outlet ports 19, 21, these could be larger. These ports could cover a large part of the two corresponding faces, stopping short of the sealing surfaces 18. This should ensure that they do not restrict air flow significantly.

Figure 5:
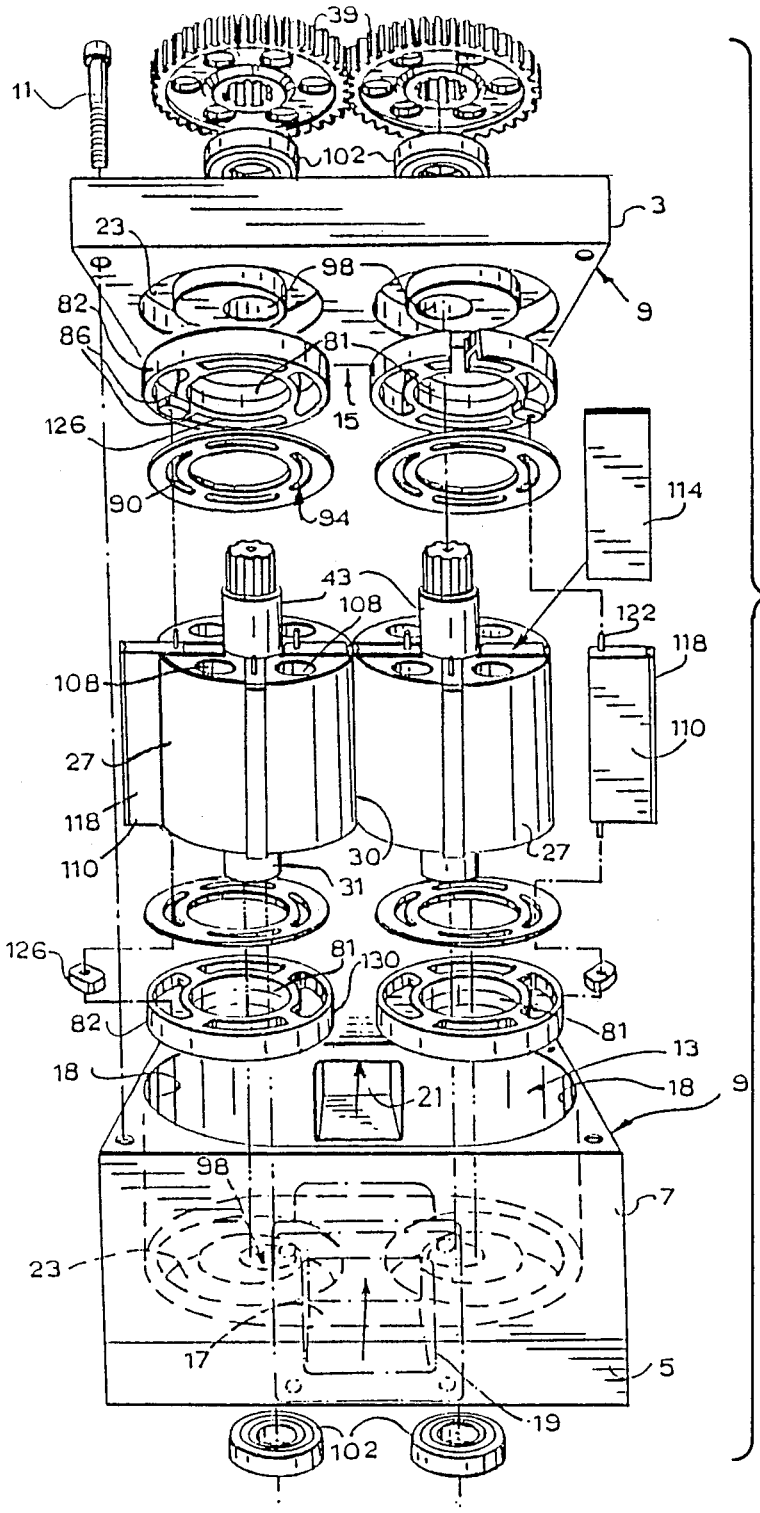
FIG. 5 is an exploded perspective view, similar to FIG. 2, of a variant embodiment of the pump.

With reference to FIG. 5, there is shown a variant embodiment of the invention. In FIG. 5, many of the components correspond to the embodiments shown in FIG. 21, and are given the same reference numeral. The difference in FIG. 5 is the angular orientation of the cylindrical rotors, which are accordingly given the reference numerals 27*a*. In FIG. 2, when the vane 110 of one rotor was in the fully retracted position extending in the plane of the rotor axes, two vanes 110 of the other rotor were located symmetrically on either side of that plane and at 45° to it.

Here in FIG. 5, when one vane 110 of one rotor is located in the plane extending between the rotor axes, a corresponding vane 110 of the other rotor is similarly aligned, with the outer surfaces of the two vanes 110 adjacent or just contacting one another.

I claim:

1. A rotary pump comprising:

a housing defining a chamber, the chamber having two end surfaces, first and second sealing surface sections extending between the end surfaces, having respective first and second axes, and inlet and outlet ports disposed opposite one another and between the sealing surfaces;

one first, circular track and one second, circular track on one end surface of the chamber, and another first, circular track and another second, circular track on the other end surface of the chamber, each of the first and second tracks being continuous, the first tracks extending around the first axis and the second tracks extending around the second axis;

a first rotor rotatably mounted within the chamber for rotation about the first axis, and including a plurality of first slots and a plurality of first fluid transfer ports providing communication between the first slots;

a second rotor rotatably mounted within the chamber for rotation about the second axis, and including a plurality of second slots and a plurality of second fluid transfer ports providing communication between the second slots;

the first and second rotors sealingly contacting one another at a contact line therebetween and between the first and second axes;

a plurality of first vanes, each vane having a stub shaft at either end and a sealing edge and being slidably received in a slot of the first rotor and rotatable therewith about the first axis with the sealing edges of the first vanes projecting outwardly;

a plurality of second vanes, each vane having a stub shaft at either end and a sealing edge and being slidably received in a second slot of the second rotor and rotatable therewith about the second axis with the sealing edges of the second vanes projecting outwardly;

a first track following means which comprises one first annular carrier rotatably mounted in said one first track, another first annular carrier rotatably mounted in said one other first track, each of the first annular carriers including an annular recess having at least one first arcuate bearing surface, and a plurality of first bearing blocks each of which includes inner and outer arcuate bearing surfaces for sliding movement along a respective annular recess and a bore, and which are mounted in the recesses of the first annular carriers for rotation therewith and for relative motion along the first arcuate bearing surfaces, with each first vane being pivotally mounted by one stub shaft to one first bearing block on said one first annular carrier and by the other stub shaft thereof to one first bearing block on said other first annular carrier;

a second track following means which comprises one second annular carrier rotatably mounted in said one second track, another second annular carrier rotatably mounted in said another second track, each of the second annular carriers including an annular recess having at least one second annular bearing surface, and a plurality of second bearing blocks each of which includes inner and outer arcuate bearing surfaces for sliding movement along a respective annular recess and a bore, and which are mounted in the recesses of the second annular carriers for rotation therewith and for relative motion along the second arcuate bearing surfaces, with each second vane being pivotally mounted by one stub shaft to one second bearing block mounted on said one second annular carrier and by the other stub shaft thereof to one second bearing block mounted on said other second annular carrier;

for each annular carrier, a respective cover plate secured thereto and covering each corresponding arcuate recess, the cover plate including a plurality of arcuate holes, corresponding to the arcuate recesses, with a respective stub shaft extending through each arcuate hole;

means for rotating the first and second rotors in opposite directions;

whereby, in use, with the rotors rotated such that the vanes contacting the sealing surfaces move from the inlet port to the outlet port, those vanes pump fluid from the inlet port to the outlet port.

2. A rotary pump as claimed in claim 1, wherein each annular carrier includes an arcuate recess for each bearing block, and a plurality of crosspieces separating adjacent recesses.

3. A rotary pump as claimed in claim 2, wherein each cross piece includes channel means providing communication between ends of the arcuate recesses.

4. A rotary pump as claimed in claim 1 or 2, wherein each rotor includes an even number of uniformly spaced slots and the fluid transfer ports provide communication between diametrically opposed slots.

5. A rotary pump as claimed in claim 2, wherein each rotor includes four slots and each annular carrier includes four equally sized annular recesses.

6. A rotary pump as claimed in claim 1, 2, or 5, wherein each sealing surface comprises part of a cylinder, the first sealing surface is concentric with the first tracks and the second sealing surface is concentric with the second tracks.

7. A rotary pump as claimed in claim 1, 2, or 5, wherein each of the sealing surfaces comprises part of a cylinder, wherein the first sealing surface is concentric with the first tracks and the second sealing surface is concentric with the second tracks, and wherein the first and second axes for the rotors are located between the axis common to the first tracks and the first sealing surface and the axis common to the second tracks and the second sealing surface, all the axes being coplanar.

8. A rotary pump as claimed in claim 1, 2, 5, or 3, wherein said means for rotating the first and second rotors in opposite directions maintains the first and second rotors at a constant angular relationship, and the rotors are aligned such that when each first slot is at the contact line between the rotors, two adjacent second slots are generally equally spaced from the contact line.

9. A rotary pump as claimed in claim 1, 2, 5, or 3, wherein the means for rotating the first and second rotors maintains the first and second rotors at a constant angular relationship, and the rotors are aligned such that, when each first slot is at the contact line between the rotors, two adjacent second slots are generally equally spaced from the contact line, and wherein the axes of the first and second rotors lie in a plane containing an axis of the first tracks and an axis of the second tracks, with the axes of the tracks being outside the axes of the rotors.

10. A rotary pump as claimed in claim 1, 2, 5, or 3, wherein the means for rotating the first and second rotors maintains the first and second rotors at a constant angular relationship, and the rotors are aligned such that corresponding slots of the two rotors become aligned between the axes of the two rotors in a plane extending through the two rotor axes and the contact line.

11. The rotary pump as claimed in claim 1 or 2, wherein each slot includes channels at its radially inner end and adjacent the sides thereof, and at its radially outer end portions stepped radially inwards to define steps, and wherein a bearing plate is provided for each side of each slot, with each bearing plate being located in a respective channel at its radially inner end and abutting a respective step at its radially outer end.

12. The rotary pump as claimed in claim 11, wherein a sealing edge strip is mounted to the radially outer edge of each vane, the sealing edge strip defining a sealing edge.

13. A rotary pump as claimed in claim 12, wherein the bearing blocks, bearing plates and the sealing edge strip are formed from a self-lubricating plastic material.

14. A rotary pump as claimed in claim 1, 2 or 3, wherein each slot includes channels at its radially inner end and adjacent the sides thereof, and at its radially outer end portions stepped radially inwards to define steps, and wherein a bearing plate is provided for each side of each slot, with each bearing plate being located in a respective channel at its radially inner end and abutting a respective step at its radially outer end.

15. A rotary pump as claimed in claim 14, wherein a sealing edge strip is mounted to the radially outer edge of each vane, the sealing edge strip defining a sealing edge.

16. A rotary pump as claimed in claim 15, wherein the bearing blocks, bearing plates and the sealing edge strip are formed from a self-lubricating plastic material.

17. A rotary pump as claimed in claim 1, 3, or 5, wherein each rotor is of circuluar cross-section.

* * * * *